US007963091B2

(12) United States Patent
Epstein et al.

(10) Patent No.: US 7,963,091 B2
(45) Date of Patent: Jun. 21, 2011

(54) INDEXING VACUUM-PACKAGING MACHINE USING A VIDEO CAMERA FOR FILM-REGISTRATION

(76) Inventors: Moshe Epstein, Northbrook, IL (US); Suzali Suyut, Indianapolis, IN (US)

( * ) Notice: Subject to any disclaimer, the term of this patent is extended or adjusted under 35 U.S.C. 154(b) by 386 days.

(21) Appl. No.: 12/264,466

(22) Filed: Nov. 4, 2008

(65) Prior Publication Data

US 2010/0112916 A1 May 6, 2010

(51) Int. Cl.
*B65B 47/00* (2006.01)

(52) U.S. Cl. ..... 53/559; 53/561; 53/427

(58) Field of Classification Search ..... 53/559, 53/561, 578, 427, 423, 510, 54, 496, 65, 53/453

See application file for complete search history.

(56) References Cited

U.S. PATENT DOCUMENTS 3,744,210 A * 7/1973 O'Lenick et al. ..... 53/433
4,048,781 A 9/1977 Johansen
4,209,957 A * 7/1980 Utzmann ..... 53/453
4,624,099 A * 11/1986 Harder ..... 53/432
4,685,274 A * 8/1987 Garwood ..... 53/433
4,951,444 A 8/1990 Epstein et al.
5,170,611 A * 12/1992 Buchko et al. ..... 53/453
5,172,854 A 12/1992 Epstein et al.
5,271,207 A 12/1993 Epstein et al.
5,517,805 A 5/1996 Epstien
5,568,715 A * 10/1996 Ebel et al. ..... 53/54
6,363,686 B1 * 4/2002 Heide ..... 53/53
6,378,572 B1 * 4/2002 Neubauer et al. ..... 141/94

OTHER PUBLICATIONS

"In-Sight Vision Systems" product guide by Cognex Corp.
"In-Sight Micro Vision System" installation manual by Cognex Corp.

* cited by examiner

*Primary Examiner* — Sameh H. Tawfik

(57) ABSTRACT

An improved indexing vacuum-packaging machine more accurately positions and aligns the upper film relative to the lower film at the sealing station. A video camera replaces a conventional photocell, whereby the braking and concomitant stretching of the upper film at the sealing station need only be performed only every few indexing cycles, whereby shaking and jerking of the machine is negated as compared to a conventional vacuum-packaging machine. The video camera may use any portion of the printed matter on the upper film as a target for determining when to brake the upper film for the subsequent stretching thereof, without having to rely solely upon the hithertofore-used one black target-box imprinted on the upper film. The video camera is focused on a section of the portion of upper film at the sealing station for detecting a predetermined target area of printed matter, which section to be detected may form any part of the printed matter, and is not limited to, and preferably not, the one black target-box located longitudinally centrally between each longitudinally repeating pattern of printed matter on the upper surface-face of the upper film. When the target image-area has been detected by the video camera apparatus and the software thereof, an output signal is generated to cause the braking mechanism of the vacuum-packaging machine at the sealing station to be actuated to brake the upper film that will stretch the upper film.

10 Claims, 9 Drawing Sheets

110
INDEXING POSITION
BREAKING POSITION?
130
YES
132
REGISTRATION SWITCH ON?
NO
YES
136
LATCH BREAK SIGNAL ON?
NO
YES
138
ACTIVATE BRAKE
YES
NO
HOLDING TIMER DONE?
140
YES
134
RELEASE BRAKE
BREAK SIGNAL ON?
170
YES
172
LATCH BREAK SIGNAL ON

140
START
142
CAMERA POWER ON
144
CAPTURE IMAGE
146
START CAPTURE IMAGE TIMER
148
PATTERN MATCHING ALGORITHM
150
PATTERN MATCH?
YES
152
PATTERN MATCH OUTPUT ON
154
REGISTRATION SWITCH ON?
YES
156
BRAKE OFF COMAND?
YES
158
FILM STABLIZING TIMER ON
160
FILM STABLIZING TIMER DONE?
NO
YES
162
BREAK SIGNAL ON
164
CAPTURE IMAGE TIMER DONE?

INDEXING VACUUM-PACKAGING MACHINE USING A VIDEO CAMERA FOR FILM-REGISTRATION

BACKGROUND OF THE INVENTION

The present invention is directed to an improvement in an indexing vacuum-packaging machine. Examples of such conventional vacuum packaging machines are disclosed in applicant's U.S. Pat. Nos. 5,271,207 and 5,517,805, for example, which references are incorporated by reference herein.

In a conventional, indexing vacuum-packaging machine, a lower film-web is indexed using an indexing advancing mechanism for situating the transverse, multiple package-receptacles formed in the lower film-web at a forming station and then to a sealing or sealing/vacuum station, where the upper film for completing the packages is applied, and vacuum-sealed. At each station, a lower tool is raised toward an upper, stationary tool for performing the requisite tasks at the respective station. However, in all indexing vacuum-packaging machines, misalignment between the upper and lower films is inevitable, owing to the fact that the longitudinal length of the lower film, taken in the direction of the indexing, constituting the length of each finished vacuum-package, after the cutting at the final cutting station, is greater than the length of the upper-film portion constituted by the printed matter, which printed matter typically consists of a repeating pattern of the name of the product contained in the package, the weight and/or quantity thereof, bar code, unique designs, and the like. This length of the printed matter on the upper film is intentionally made shorter than the length of the lower-film package-length, in order that the upper film may be slightly stretched at the vacuum-sealing station, in order to form a tight vacuum seal.

The material from which the upper is made is flexible and stretchable, which allows of the stretching thereof. In a conventional vacuum-packaging machine, the upper film is stretched every indexing cycle by means of brakes applied to the upper film at the sealing station. However, it is not possible to stretch the upper film in such a precise manner as to ensure continuous and proper registration and alignment of the upper film with the lower film in both the longitudinal and transverse direction relative to the lower film. Thus, longitudinal mis-registration, as well as transverse misalignment, is inevitable. The amount of stretching of the upper film is controlled and determined by the use of a dedicated photocell mounted above the indexed upper film at the sealing station. This photocell typically detects one black target-box per indexing cycle imprinted on the upper film, as mentioned above. This one, black target-box is located longitudinally centrally of the printed matter, at the end of the portion of the repeating pattern constituting the upper film of the central or middle package of the multiple packages being formed simultaneously at the sealing station. This black box of the printed matter of the upper film is used to indicate the end of the printed matter for each indexing cycle, and, therefore, the end of the length of the upper film to be sealed to the lower film at the sealing station. The photocell uses this black target-box to ensure that longitudinal registration is maintained between the upper and lower films for each indexing cycle. Thus, when the photocell detects that black target-box during each indexing cycle, it outputs a signal to cause the braking mechanism at the sealing station to brake the upper film for a predetermined time period in order to stretch the upper film the requisite amount in order to increase the length of the portion of the upper film between the upper-film supply and the portion of the upper film sealingly connected to the lower film at the sealing station during the previous indexing cycle. Ideally, this braking will stretch the upper film the exact amount equivalent to the difference between the length of the lower film at the sealing station containing the multiple, transverse receptacles formed simultaneously by the indexing machine during each indexing cycle and the length of the printed matter on the upper film. However, in reality, this is not case. This is so, because the photocell used for detecting the black target-box does not typically have a high resolution, and will often detect other printed matter on the upper film and assume that it is the target box. Moreover, since application by the brakes every indexing cycle creates formidable and considerable forces and jerking of the entire machine, transverse, or lateral, shifting, or creeping, of the upper film occurs, thus causing lateral or transverse misalignment between the edges of the upper and lower films. Since there is only black target-box imprinted on the upper film for each indexing cycle, at the center position of the upper film constituting the center, or middle, package being formed during the indexing cycle, it often occurs that the photocell will not detect any printed matter at all during any indexing cycle, or will interpret other printed matter as being the target. Thus, that indexing cycle will produce ill-formed packages, necessitating the operator of the machine to stop the machine, to remove the contents of the packages formed during that indexing cycle, and to reset or re-align the upper film so that the photocell will again be able to detect a black target-box the next indexing cycle. This problem has led to considerable downtime of the packaging machine, and the concomitant loss of productivity.

FIGS. 1 and 2 show the sealing station of a conventional vacuum-packaging machine, where the upper film layer and the lower film layers, forming the horizontal row or rows of filled vacuum-packages, are heat-sealed together via an upper heating tool after the rectangular-shaped lower and upper tools of the sealing station have been brought against each other, and after a vacuum has been formed in the each package of the row of packages. A sealing station 20 consists of a supply 36 of upper plastic film 22 constituting the upper layer of the finished vacuum packages and is unrolled to a location juxtapositioned above the product-filled pocket-receptacles of the lower film. The upper film 22 is delivered to the sealing station proper via guide rollers 40, 42, 44, and 46, it being understood that a conventional tensioning arm or arms are provided in the usual manner for controlling tension of the transported film. At the sealing station 20, the upper film is heat-sealed to the lower film, during which sealing a vacuum is formed in the packages via a nozzle-head 28. The sealing station has an upper chamber 24 in which is mounted for relative movement a heating tool 25, which heating tool has a lower projecting perimetric, or peripheral, heating element 25'. The upper tool abuts against a lower tool 26 when the upper and lower tools are brought into abutting contact against each other during the sealing process during each indexing cycle, with upper and lower tools holding the upper film and lower films, respectively, by suction. Either the upper tool 24 or lower tool 26 may be movable toward the other, with the other usually being stationary. The number and rows of vacuum packages being sealed at the sealing station will vary depending upon the product. For example, there may be two rows of four vacuum packages for each row being heat sealed at the sealing station. The lower tool will have the appropriate mold configuration depending upon the number of rows and number of packages per row. During each indexing cycle, the supply film 22 is stretched by a braking mechanism (not shown) in order to stretch the length thereof, in the manner described hereinabove.

Referring to FIG. 4, there is shown a longitudinal and transverse section or portion of conventional upper film 22 used in a conventional vacuum-packaging machine in which has been imprinted a transverse, or lateral, repeating pattern 52 of printed matter 50, with each repeating pattern 52 constituting the printed matter on the upper film-layer of a finished vacuum-package with contents. The number of repeating patterns 52 is equal to the number of lateral packages formed in the lower film at the forming station. Each repeating pattern 52 of the printed matter 50 may typically consist of the following: contents of the package, weight and/or quantity of the contents, bar code, name of manufacturer, logo or trademark, and the like. In addition, the printed matter 50 also consists of one, longitudinally and centrally located black target-box 54 used for detection by a photocell, as described above.

SUMMARY OF THE INVENTION

It is the primary objective of the present invention to provide an improved indexing packaging machine that will more accurately position and align or register the upper film relative to the lower film at the sealing station of a vacuum-packaging machine.

It is the primary objective of the present invention to provide such an improved vacuum-packaging machine in which is provided a video camera that replaces a conventional photocell, whereby the braking and concomitant stretching of the upper film at the sealing station need only be performed only every few indexing cycles, whereby shaking and jerking of the machine is negated as compared to a conventional vacuum-packaging machine.

It is the primary objective of the present invention to provide such an improved vacuum-packaging machine with video camera whereby any portion of the printed matter on the upper film may be used as a target image, or pattern identification, for determining when to brake the upper film for the subsequent stretching thereof, without having to rely solely upon the hithertofore-used one black target-box imprinted on the upper film between longitudinally-repeating patterns of the printed matter on the upper film, thus obviating the inherent drawbacks of prior-art vacuum-packaging machines associates with the use of the detection of only this one black target-box.

Toward these and other ends, the improved vacuum-packaging machine comprises a video camera mounted above a portion of the upper film at the sealing station between the supply of upper film and the portion of the upper film previously sealed to bottom film during the previous indexing cycle. The video camera is focused on a section of this portion of upper film at the sealing station for detecting a predetermined target area, or pattern identification, of printed matter imprinted on the upper surface-face of the upper film. This section to be detected may form any part of the printed matter, and is not limited to, and preferably not, the one black target-box located longitudinally centrally between each longitudinally repeating pattern of printed matter on the upper surface-face of the upper film. The image of this predetermined target image is digitally stored in software associated with the video camera apparatus, in order that an image detected by the video camera may be compared thereto in a continuous manner during each indexing cycle.

According to the present improved vacuum-packaging machine, with the upper film stationary at the sealing station between indexing cycles, when a target image-area has been detected, or identified, by the video camera apparatus and the software thereof, an output signal is generated to cause the braking mechanism of the vacuum-packaging machine at the sealing station to be actuated to brake the upper film thereat that will stretch the upper film an amount that is at least greater or equal to the difference between the length of the lower film at the sealing station containing the multiple, transverse receptacles formed simultaneously by the indexing machine during each indexing cycle—which length is equal to the length of each indexing cycle—and the longitudinal length of the transverse repeating patter of printed matter on the upper film. For a detection of a pattern-identification target every five indexing cycles, the upper film is stretched five times the value of the above-mentioned difference between the length of the lower film and the length of the transverse repeating pattern of the printed matter on the upper film. This frequency of detection of the target-area depends upon the value of this above-mentioned difference. For a relatively small value of this difference, the frequency of detection of the target-area may be as infrequent as once in twenty indexing cycles, thus ensuring infrequent application of the braking mechanism for stretching the film, and the concomitant considerable lessening or elimination of all jerking, shaking and vibrations of the machine during the braking operation, and the subsequent obviation of transverse or lateral misalignment of the upper film relative to the lower film, in contrast to a conventional vacuum-packaging machine utilizing a photocell that actuates the braking mechanism every indexing cycle.

BRIEF DESCRIPTION OF THE DRAWINGS

The invention will be more readily understood with reference to the accompanying drawings, wherein.

DETAILED DESCRIPTION OF THE INVENTION

Figure 1:
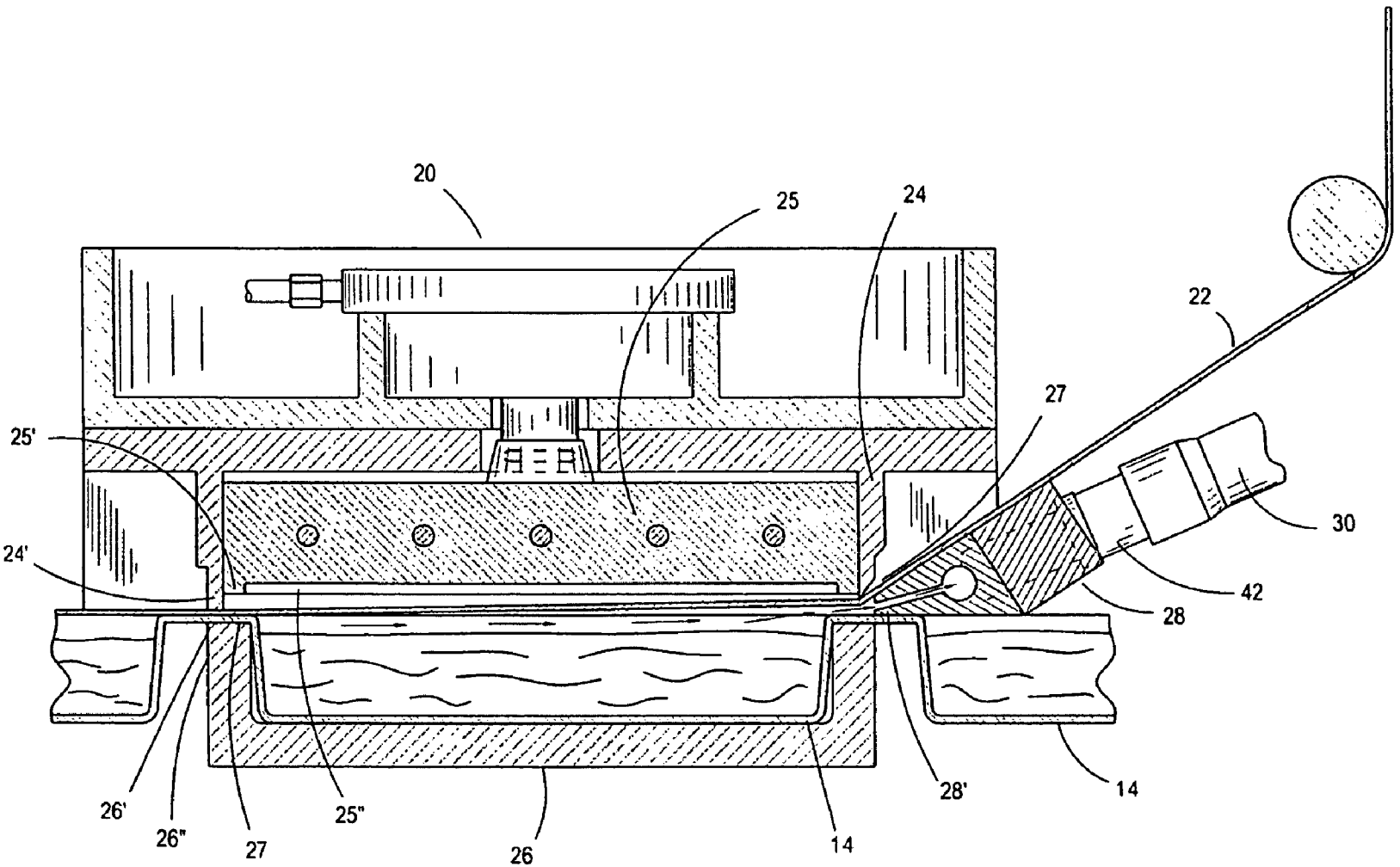
FIG. 1 PRIOR ART
FIG. 1 is a vertical cross-sectional view of a prior art sealing station of a conventional vacuum-packaging machine.
Figure 2:
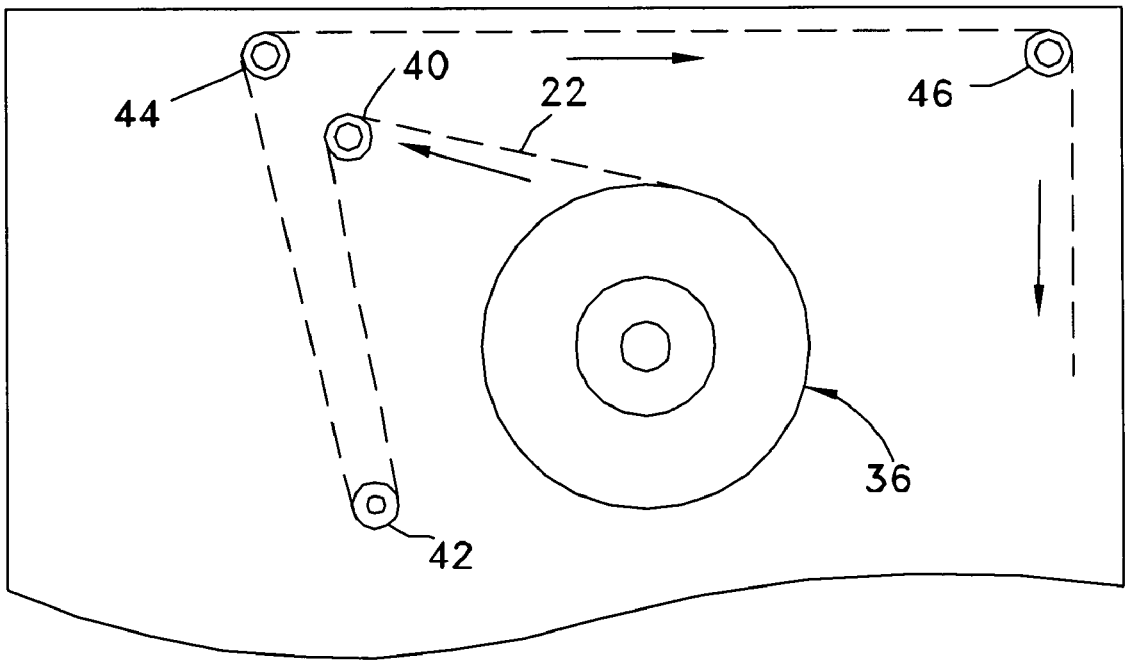
FIG 2 PRIOR ART
FIG. 2 is a plan view of the feeding rollers and supply roll of upper film used in the prior-art sealing station of FIG. 1.
Figure 3:
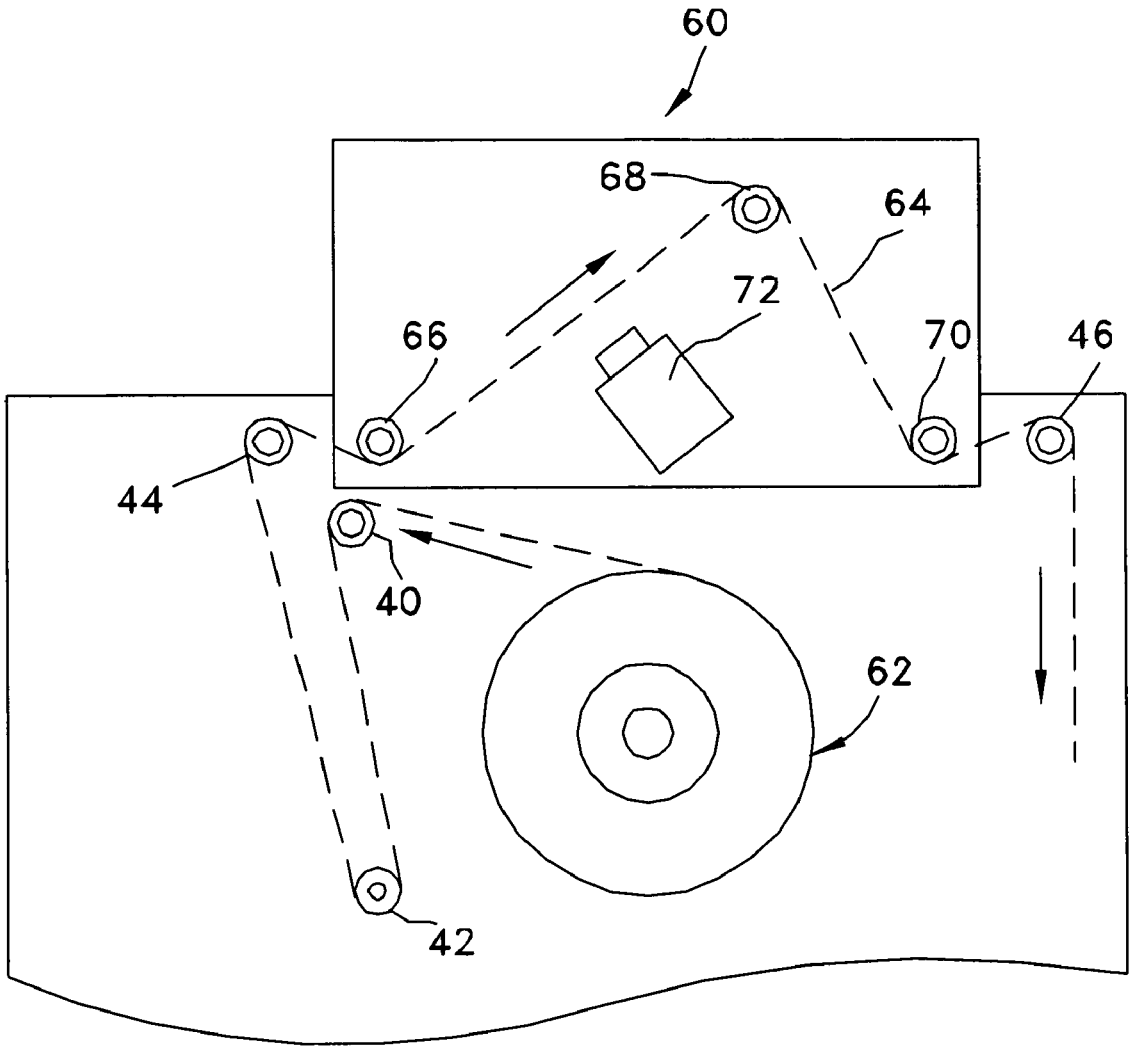
FIG. 3 is a side view of a sealing station of a vacuum-packaging machine incorporating the video-camera apparatus of the invention that is used in detecting misalignment between the upper and lower films at the sealing station.

Referring now to the drawings in greater detail, in FIG. 3 there is shown a sealing station 60 of a conventional vacuum packaging machine, such as that disclosed in U.S. Pat. No. 5,271,207, which reference is incorporated by reference herein. The sealing station 60 consists of a supply roll 62 of plastic film 64 constituting the upper layer of the finished vacuum packages and is unrolled to a location juxtapositioned above the product-filled pocket-receptacles formed in the lower film. At the sealing station, the upper film is heat-sealed to the lower film, during which sealing a vacuum is formed in the packages via a nozzle-head, as described hereinabove. The sealing station 60 is similar to the prior-art sealing station 20, with the exception of the addition of extra guide rollers 66, 68, and 70 for directing the upper film 64 upwardly above a video camera 72 used for detecting a predefined portion of the printed matter imprinted on the upper face of the upper film, which predefined portion constitutes the image-pattern or target used for braking the upper film during registration of the upper and lower films, as described in detail hereinbelow. The video camera 72 replaces the conventional photocell hithertofore used. The video camera is mounted to the main frame of the vacuum packaging machine at the sealing station in a conventional manner, such as by brackets. The video camera 72 may be "COGNEX" "In-Sight Micro" video system, models 1020, 1050, 1100, 1110, 1400, 1410, 1403, and 1413.

Figure 4:
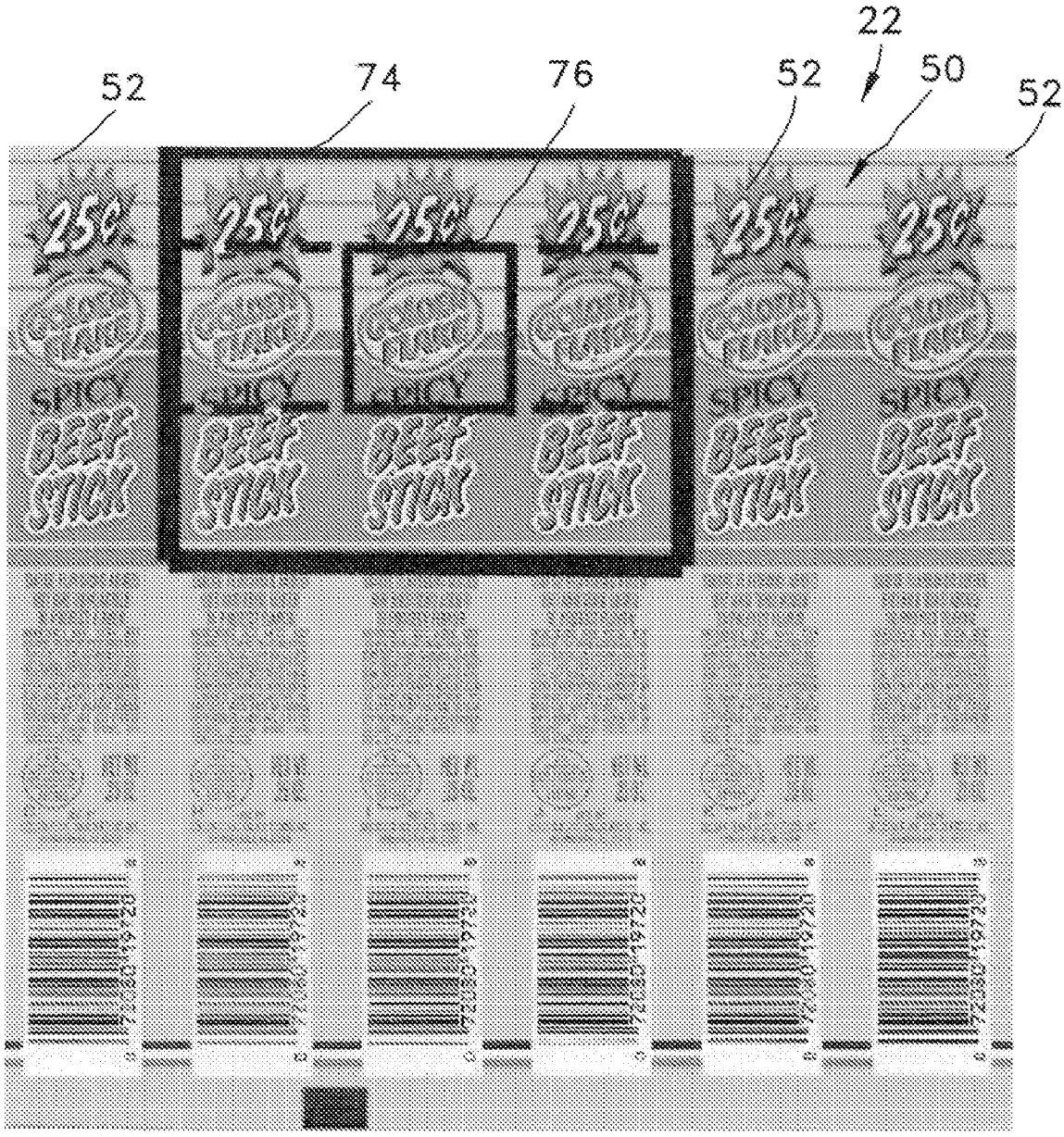
FIG. 4 is a top view of a section of a conventional upper film used in a conventional vacuum-packaging machine in which has been imprinted transverse, or lateral, repeating patterns of printed matter, with each repeating pattern constituting the printed matter on the upper film-layer of a finished vacuum-package with contents, there being shown a first, larger boxed viewing area constituting the view of the video camera apparatus, and a second, smaller boxed area of the repeating pattern of printed matter imprinted on the upper face of the upper film that is used as a predetermined pattern-match or target that is to be sensed by the video camera apparatus during an indexing cycle.
Figures 5, 5A, 5B, 5C:
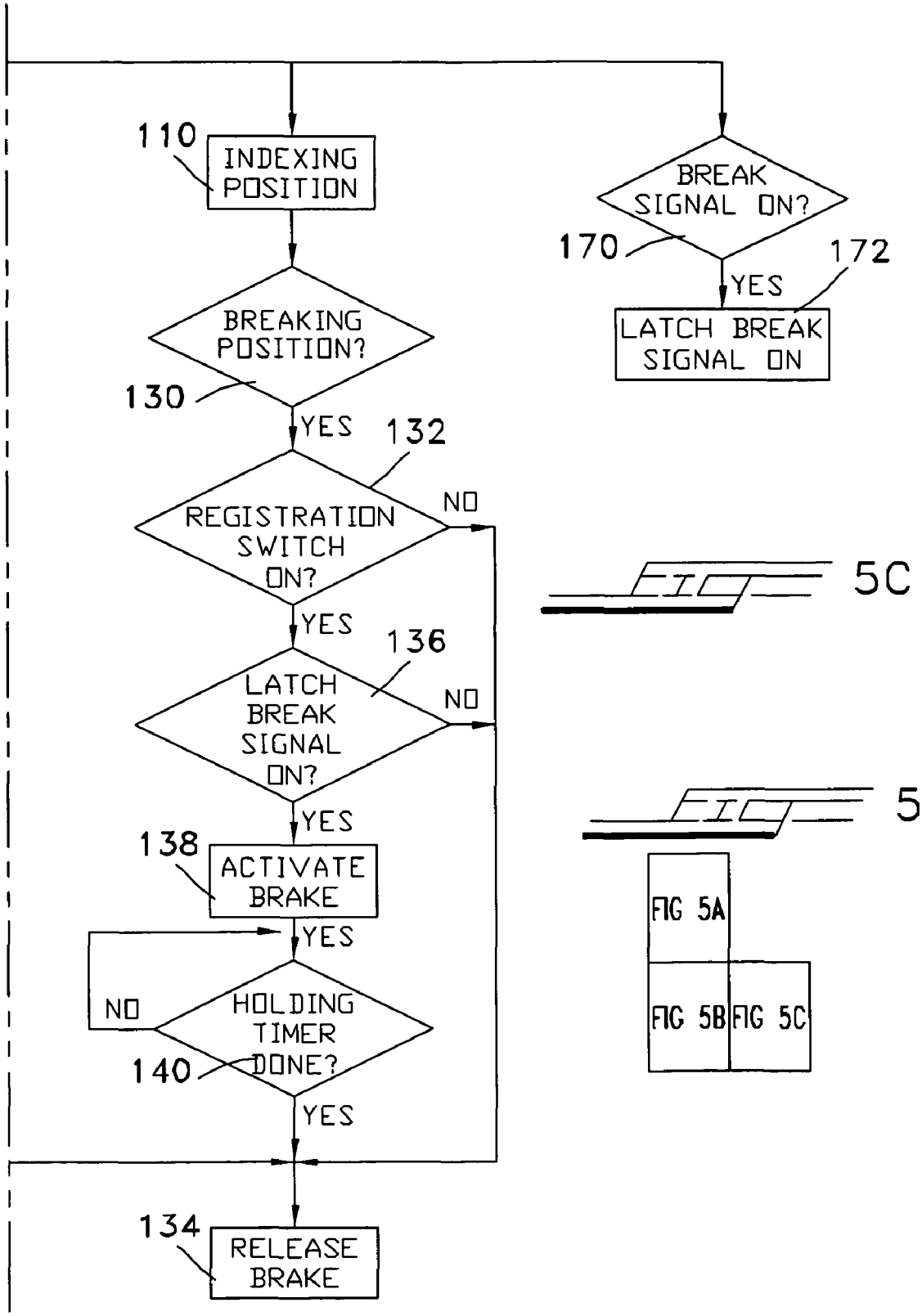
FIGS. 5A-7 are flow charts of the invention by which the target image is detected by the video camera while the upper film is stationary at the sealing station between indexing cycles.
Figure 5A:
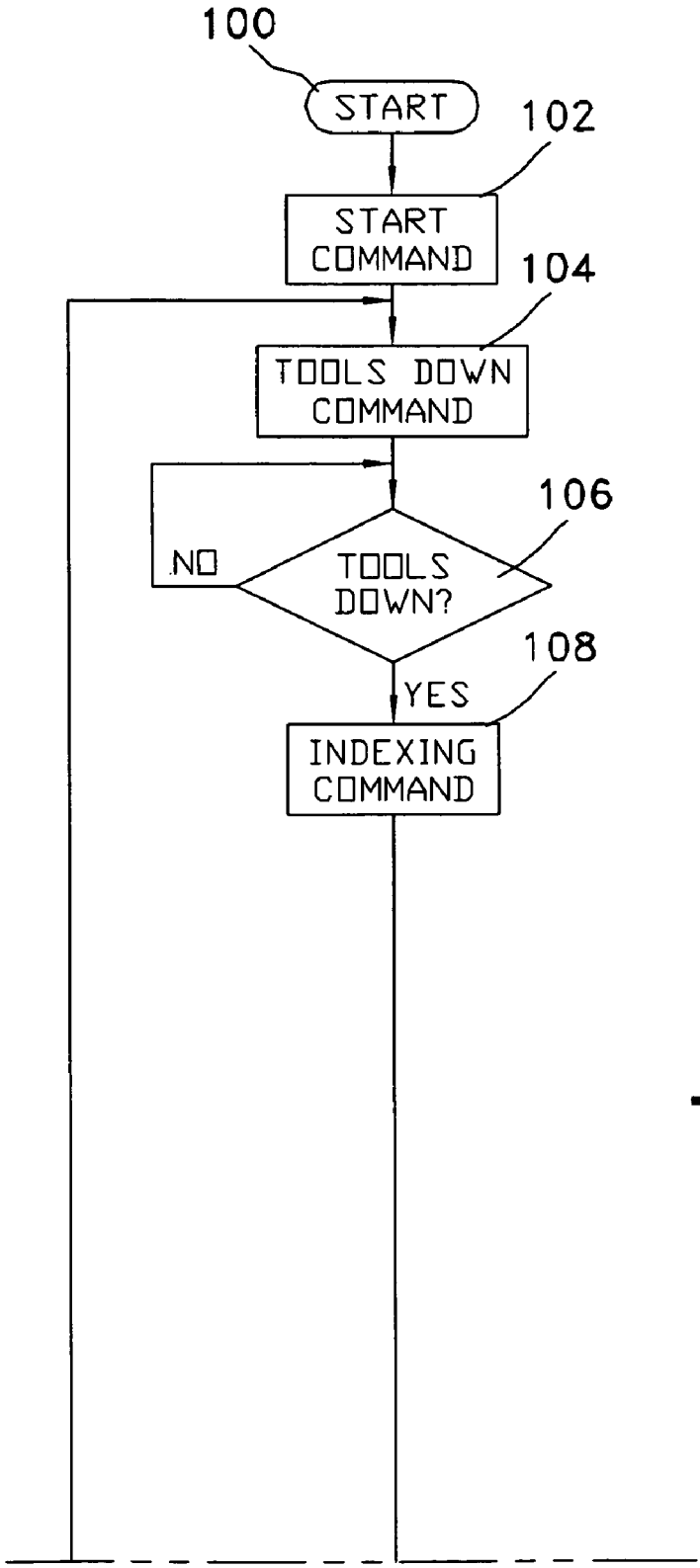
Figure 5B:
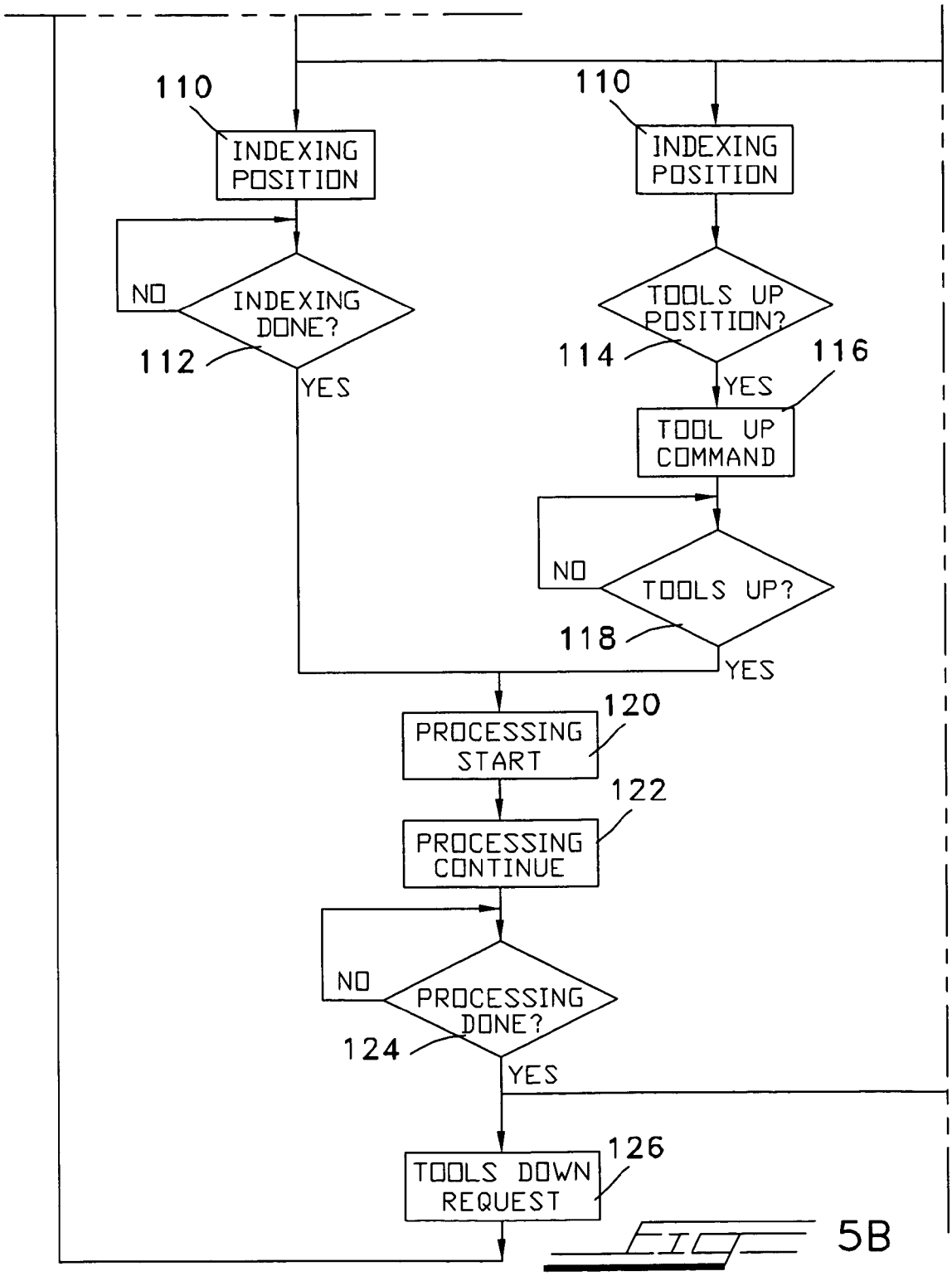

Referring now to FIG. 4, there is shown a transverse and longitudinal section of the conventional upper film 64 used in a conventional vacuum-packaging machine in which has been imprinted transverse, or lateral, repeating patterns of printed matter, with each repeating pattern constituting the printed matter on the upper film-layer of a finished vacuum-package with contents, as described hereinabove. There is also shown a first, larger boxed viewing area 74 that constitutes the view of the video camera apparatus 72, and a second, smaller boxed area 76 of the repeating pattern of printed matter imprinted on the upper face of the upper film that is used as a predetermined pattern-match or target that is to be sensed by the video camera apparatus during an indexing cycle. This target or image-pattern 76 may be any part of the printed matter on the upper film, and not just—and preferably not—the black box 54 used by the photocells in the prior-art systems, as discussed hereinabove. The video camera 72 is focused on a section of this portion of upper film at the sealing station, as depicted by the larger rectangular box 74, for detecting the predetermined target, or image-pattern identification, of printed matter imprinted on the upper surface-face of the upper film, as depicted by the smaller rectangular box 76. The section 74 to be viewed and the image-pattern identification 76, may form any part of the printed matter, and not just that depicted in FIG. 4. The image of this predetermined image-pattern identification 76, or target, is digitally stored in memory associated with the video camera apparatus, in the conventional manner, in order that an image detected by the video camera may be compared thereto in a continuous manner during each indexing cycle, for serving as the reference thereagainst.

When the upper film is stationary at the sealing station between indexing cycles, and when an image-pattern identification 76, or target image-area, has been detected, identified, and matched against the reference template of the image stored in the memory of the video camera system 72, using the conventional software of the video camera system, an output signal is generated to cause the conventional braking mechanism (not shown) of the vacuum-packaging machine at the sealing station to be actuated to brake the upper film during the end of the next indexing cycle at the preset location and will stretch the upper film an amount that is greater than the difference between the length of the lower film at the sealing station containing the multiple, transverse receptacles formed simultaneously by the indexing machine during each indexing cycle—which length is equal to the length of each indexing cycle—and the longitudinal length of the transverse repeating patter of printed matter on the upper film. For a detection of a pattern-identification target every five indexing cycles, the upper film is stretched five times the value of the above-mentioned difference between the length of the lower film and the length of the transverse repeating pattern of the printed matter on the upper film. This frequency of detection of the target-area depends upon the value of this above-mentioned difference. For a relatively small value of this difference, the frequency of detection of the target-area may be as infrequent as once in twenty indexing cycles, thus ensuring infrequent application of the braking mechanism for stretching the film, and the concomitant considerable lessening or elimination of all jerking, shaking and vibrations of the machine during the braking operation, and the subsequent obviation of transverse or lateral misalignment of the upper film relative to the lower film, in contrast to a conventional vacuum-packaging machine utilizing a photocell that actuates the braking mechanism every indexing cycle.

The video camera system detects the predetermined pattern-identification target 76 on the upper face of the upper film at a frequency F equal to N indexing cycles, where F is a numeral greater than one representing the frequency of detection of a predetermined target 76 by the video camera system, and N is a numerical value greater than one, whereby the video camera system detects a predetermined pattern-identification target on a repeating pattern of printed matter of the portion of the upper face of the upper once every N indexing cycles. Upon the video camera's detection of the predetermined pattern-identification target 76, the software program of the video camera system produces an output signal for braking the upper film in order to stretch the portion of the upper film at the sealing station an approximate length L, where L is equal to Nd, where N is greater than one, and d is the difference between the length of an indexing cycle and the length of a repeating pattern of printed matter on the portion of the upper face of the upper film. As an example, N may be defined as: $25>N>1$.

The software program of the video camera apparatus comprises a portion thereof that produces the output signal during the downward movement of the lower tool of the sealing station but before the end of the current cycle has occurred, which end of the current indexing cycle is defined as the tool's-down position of the lower tool of the sealing station. This portion of the software program actuates the machine's conventional braking mechanism to brake the upper film during the next indexing cycle, after the current indexing cycle.

The braking mechanism is actuated at the end of the indexing movement in order to stretch the portion of the upper film at the sealing station, that extends between the supply of upper film and the rearward sealed end of a transverse section of the upper film sealed to the corresponding end of the lower film during the current indexing cycle, an amount greater than the difference between the length of one indexing cycle and the length of a repeating pattern of printed matter on the portion of the upper face of the upper film that constitutes the upper sealing layer of a package being sealed at the sealing station, which length is taken in the longitudinal indexing direction. The stretching of the upper film at the sealing station is defined by the approximate length L, where L is equal to Nd, where N is said numeral greater than one, and d is above-mentioned difference between the length of one indexing cycle and the length of a repeating pattern of printed matter on the portion of the upper face of the upper film.

In the preferred embodiment, the software of the video camera system actuates the braking mechanism at the sealing station during the downward movement of the lower tool at the sealing station and before the end of the current indexing cycle has occurred, which end of the current indexing cycle is defined as the tool's-down position of the lower tool at the sealing station. Thus, in the preferred embodiment, the predetermined target on a repeating pattern of printed matter on the upper face of the upper film is detected by the video camera when the upper film is stationary at the sealing station between indexing cycles.

Referring now to FIGS. 5A-7, there is shown the machine-sequence routine flow chart of the software stored in memory of the video camera system for performing the above-described events according to the preferred embodiment. In blocks 100, 102, the "start" command is initialized. The software initiates the "tools down" command to bring the sealing tool down to its initialized, lowermost, rest position for starting the next indexing cycle (block 104). Decision block 106 determines if the "tools down" state has been completed. If "NO", then the loop cycles back until the answer to decision block 106 is "YES", meaning that the sealing operation at the sealing station for the current indexing cycle has been completed, with the sealing tool of the sealing station having been lowered back down to its resting, initialized position to start the next indexing cycle, whereupon the next indexing of the upper and lower films is commenced via the generation of the "indexing command" (block 108). In blocks 110, the software checks the status of the indexing positions of the indexing cycle. If the answer is "NO" to decision block 112, then it loops back. If the answer to decision block 112 is "YES", indicating that the indexing has been completed for the next indexing cycle, with the upper and lower films appropriately advanced, the software continually monitors the state of the sealing tool at the sealing station in order to determine its status (block 114), since, in accordance with the first embodiment, the video camera will not look for the target area until the sealing tool is in its downward-most, rest position, after the sealing operation at the sealing station has been completed. The software then generates the "tools up" command (block 116), and monitors the state of the tool (decision block 118). If the answer is "NO" to decision block 118, then the loops back. If it is "YES", it means that the sealing tool has been moved upwardly to its uppermost position for performing the sealing operation. If the answer is "YES" to both decision blocks 112 and 118, then the software proceeds to control the sealing process at the sealing station (blocks 120 and 122). In decision block 124, the software determines if the sealing process has been completed or not. If the answer is "NO" to decision block 124, then the loops back to block 122. If the answer is "YES" to decision block 124, meaning that the sealing operation at the sealing station for the current indexing cycle has been completed, then the software will generate the "tools down" request command (block 126) for lowering the sealing tool back down to its lowermost, rest position for starting the next indexing cycle, with the software looping back to block 104 for monitoring and controlling the next indexing cycle.

In the above-described steps, it has been assumed that the video camera system has not detected the target area that would have generated an output to the braking mechanism for causing the braking and stretching of the upper film, as describe hereinabove, for continually registering the upper and lower films together. Thus, the software also monitors the state of the braking signal or position (block 130) for the braking mechanism, which braking signal is controlled by the software of the video camera system. If no registration switch signal has been generated during the current indexing cycle, then in decision block 132 the answer is "NO", and the brake of the braking mechanism is in its release-state (block 134), meaning that the upper film will be not stretched the next indexing cycle.

If, however, during any indexing cycle the camera were to detect the pattern-matching image, as described hereinabove, then it will actuate a braking a command, and described in detail hereinbelow, for causing the braking of the upper film via the braking mechanism for the film-supply of the sealing station. Assuming that the camera will detect the pattern-matching image of the target every twenty indexing cycles, meaning that the upper film is stretched by the braking mechanism twenty times the length "d", where "d" is the difference between the length of an indexing cycle and the length of a repeating pattern of printed matter on the portion of the upper face of the upper film, as described hereinabove, then the software, in response to an output from the video camera system, will generate an actuating registration-switch signal to actuate the braking mechanism of the sealing station during the next indexing cycle every twenty indexing cycles. This generation of the output from the video camera system will cause the answer to decision block 132 to be "YES", to thus cause a "latch brake" signal to be generated (decision block 136). Since there is a time lag between the actuating registration-switch signal of block 132 and the "latch brake" signal of block 136, decision block 136 first decides if the "latch-brake" signal has actually been generated. If the answer to decision block 136 is "NO", the program proceeds to block 134, where the brake mechanism remains in its released state. If the answer to decision block 136 is "YES", meaning that the brake-latch signal has been output, then the braking mechanism is activated (block 138), at a predetermined location before the end of the indexing movement and held in its activated state to establish sealing. As for the example given above, it will be held a time to allow for the upper film to be stretched twenty times the value of "d". Decision block 140 determines when the timer has counted down, and after it has counted down, the program proceeds to release the brake (block 134), as described above.

It is noted that there is a time lag between the output from the video cameras after having detected the pattern-matching image of the target and the time that the brake is activated, owing to the time delay caused by the intermediaries of conventional relay and solenoid-switch equipment of the sealing station. This time delay is typically between 40-50 milliseconds. Therefore, the brake is applied from between 1¼ and 1½ inches before the end of the current indexing cycle. For the example given above, where the pattern-matching image of the target is detected every twenty cycles, the upper film will be stretched ¼ inch. This is calculated as follows. If the camera produces an output every twenty cycles, and stretches the upper film ¼ inch, then "d" equals ¼ inch divided by 20 equal 1/80 inch. Or, put another way, with a "d" of 1/80 inch, if one wants to stretch less frequently, say every twenty indexing cycles, then it must be stretched a total of ¼ inch every twenty cycles. After twenty cycles, the target image will again fall within the reference viewing frame of the camera to cause an output from the camera to activate the brake to again stretch the upper film ¼ inch. The smaller the value of "d" is, the less stretching required and the less stress and strain on machine and less vibration and jerking, which will thus prevent lateral misalignment of the upper film. That is, after twenty cycles, the line of misalignment between the end of the upper-film's printed matter and the end of the lower-film package increases 1/80 inch every cycle, and for twenty cycles that is ¼ inch, which is the amount the upper film is stretched during the 21$^{st}$ cycle. It is also noted that the target image need only be within the camera's reference viewing area of between 60-80% for the camera to produce an output to activate the brake.

Figure 6:
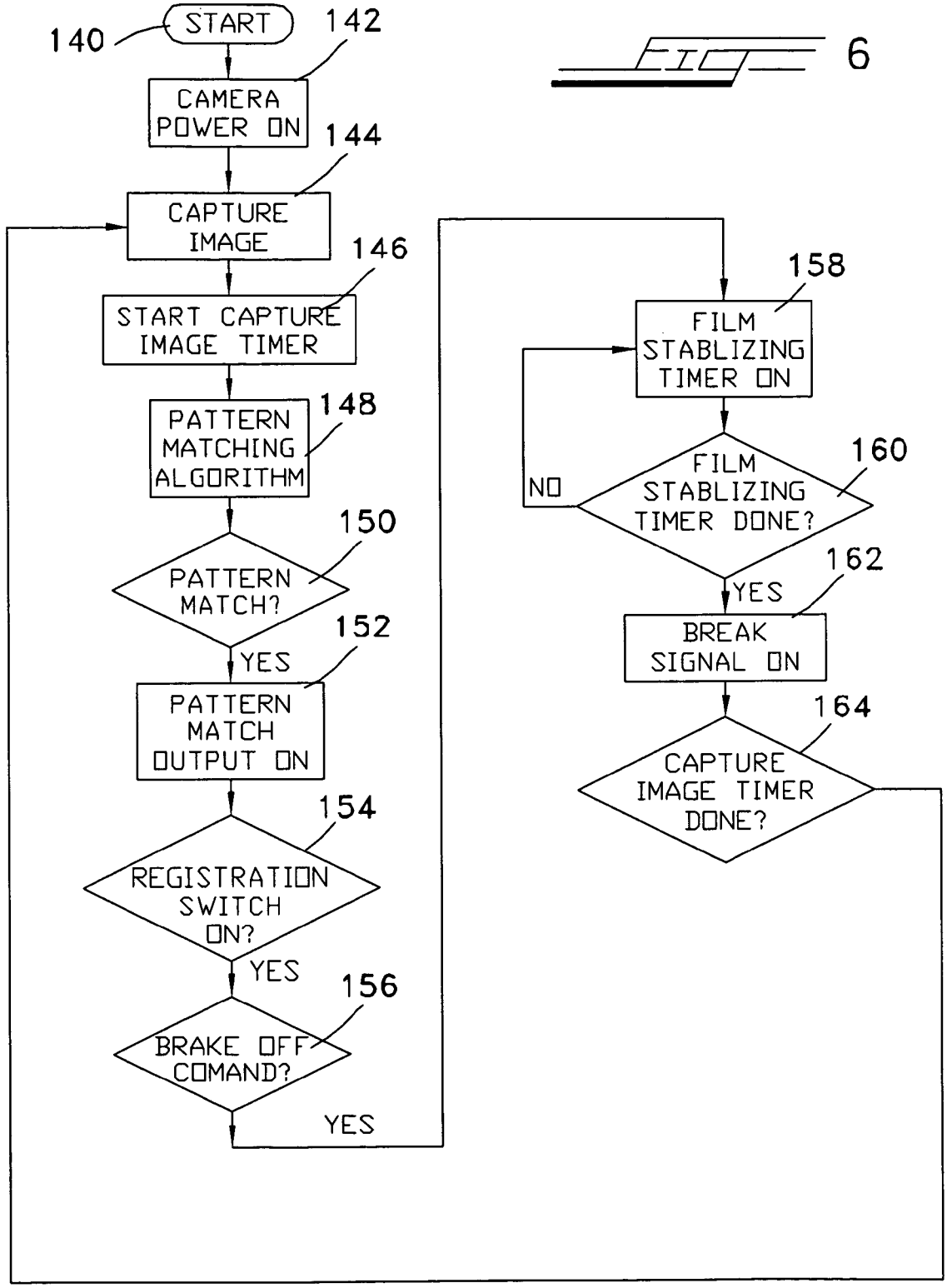

The "pattern identification" routine of the video camera is shown in FIG. 6. After initialization and camera "ON" (blocks 140, 142), the video camera system continually captures an image of the section of the upper film stationarily positioned opposite its lens. In the preferred embodiment, this occurs during the periods when the upper film is stationary at the sealing station, when the sealing process is occurring during the current indexing cycle (blocks 144 and 146). Each captured image is compared against the stored image in order to determine when there is a pattern-matching image of the target, as described above (block 148). In decision block 150, the routine determines if there is such a match. If the answer is "NO", meaning no match is present and that the full "N" cycles have not been completed, then no output signal will have been generated to activate the braking mechanism, and the software proceeds as detailed above with regard to the description of blocks 110-134. However, if the answer to decision block 150 is "YES", meaning a pattern-match has been detected by the camera, then the video camera system produces a "pattern match" output (block 152) to produce the "registration switch" actuating signal. Decision block 154 determines that this "registration switch" actuating signal has been turned on, and, if owing to time delay it has not been turned on, the routine loops back to block 152, until the answer to decision block 154 is "YES", at which point decision block 156 determines if it is within the window of opportunity to generate the braking signal (block 158). If the answer to decision block 156 is "NO", meaning that the sealing tool has yet not been moved down to its downward rest-position that is between 1¼ and 1½ inches for example, as noted hereinabove, before the present indexing cycle which is the one after the previous indexing cycle during which the pattern-match output was activated ("YES" to block 154). If the answer to decision block 156 is "YES", meaning the 1¼ and 1½ inches before the end of the current, or present, indexing cycle has been reached, then the brake signal is generated (block 158). In decision block 160, the routine determines if the capture-image" timer has run down. If the answer is "YES", meaning that the braking mechanism has been actuated and ready to brake, then the routine returns to block 144 for the next capturing of an image during the next indexing cycle, with the software continuing to block 170 of FIG. 5A where the routine activates the latch-brake signal (block 172), and then proceeds to block 136.

Figure 7:
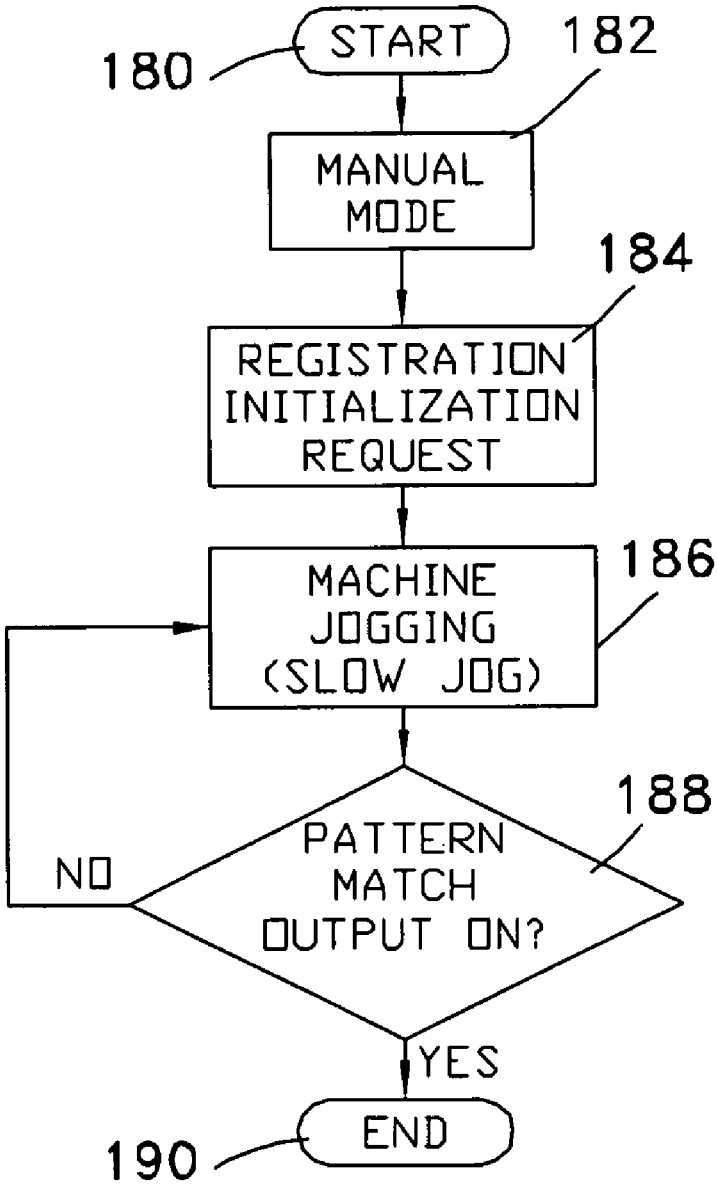

There is also shown in the FIG. 7 the initial, manual "registration initialization" routine, which is done the first time the system of the invention is used on a machine. The routine is started (blocks 180, 182, 184), and then the machine is slowly jogged; that is, the machine is manually jogged (block 186) until the desired pattern-match target to be used as the target-references has been captured by the video camera and stored in the memory of the video camera system. If there is no match ("NO" to decision block 188), then the routine loops back to block 186 for further slow, manual jogging of the machine. If the answer to decision block 188 is "YES", meaning the desired pattern-match has been detected and stored in the memory of the video camera system, then the routine ends (block 190).

It is noted that there is a time lag between the output from the video cameras after having detected the pattern-matching image of the target and the time that the brake is activated, owing to the time delay caused by the intermediaries of conventional relay and solenoid-switch equipment of the sealing station. This time delay is typically between 40-50 milliseconds. Therefore, the brake is applied from between 1¼ and 1½ inches before the end of the current indexing cycle. For the example given above, where the pattern-matching image of the target is detected every twenty cycles, the upper film will be stretched ¼ inch. This is calculated as follows. If the camera produces an output every twenty cycles, and stretches the upper film ¼ inch, then "d" equals ¼ inch divided by 20 equal 1/80 inch. Or, put another way, with a "d" of 1/80 inch, if one wants to stretch less frequently, say every twenty indexing cycles, then it must be stretched a total of ¼ inch every twenty cycles. After twenty cycles, the target image will again fall within the reference viewing frame of the camera to cause an output from the camera to activate the brake to again stretch the upper film ¼ inch. The smaller the value of "d" is, the less stretching required and the less stress and strain on machine and less vibration and jerking, which will thus prevent lateral misalignment of the upper film. That is, after twenty cycles, the line of misalignment between the end of the upper-film's printed matter and the end of the lower-film package increases 1/80 inch every cycle, and for twenty cycles that is ¼ inch, which is the amount the upper film is stretched during the 21$^{st}$ cycle. It is also noted that the target image need only be within the camera's reference viewing area of between 60-80% for the camera to produce an output to activate the brake.

It is noted that the target area may also be detected by the video camera while the upper film is in translation during indexing movement rather than when the upper film is stationary. Thus, the video camera may detect the target area in a repeatable location regardless of the stretch or not effected by the stretch.

While a specific embodiment of the invention has been shown and described, it is to be understood that numerous changes and modifications may be made therein without departing from the scope and spirit of the invention.

What is claimed is:

1. In an indexing packaging machine comprising a main frame, a sealing station at which an upper film having a repeating pattern of printed matter on the upper face thereof is sealingly attached to a lower film, which sealing station comprises a vertically-movable lower tool and an upper tool, a sensor for sensing misalignment of the upper film relative to the lower film, and a braking mechanism for braking the upper film in order to cause the stretching of a portion of the upper film at said sealing station, the improvement comprising:

said sensor comprising a video camera apparatus focused on said portion of the upper film at said sealing station for detecting a predetermined pattern-identification target on a said repeating pattern of printed matter on the upper face of the upper film, and an actuator for actuating said braking mechanism when a predetermined pattern-identification target of a said repeating pattern of printed matter has been detected by said video camera apparatus;

said video camera apparatus comprising a memory and software program stored in said memory, said software program comprising a first section for storing an image of the predetermined pattern-identification target on the upper face of the upper film and a second section for producing an output signal for said actuator for braking the upper film a predetermined length of time when a predetermined pattern-identification target on a said repeating pattern of printed matter has been detected;

said second section producing said output signal for said actuator of said braking mechanism for stretching said portion of the upper film an amount greater than the difference between the length of an indexing cycle and the shorter length of a said repeating pattern of printed matter on said portion of the upper face of the upper film that constitutes the upper sealing layer of a package being sealed at said sealing station, which length is taken in the longitudinal indexing direction;

said software program comprising a detecting portion for detecting a predetermined pattern-identification target on the upper face of the upper film at a frequency F equal to N indexing cycles, where F is a numeral greater than one representing the frequency of detection of a predetermined target by said video camera apparatus, and N is a numerical value greater than one, whereby said video camera apparatus detects a predetermined pattern-identification target on a said repeating pattern of printed matter of said portion of the upper face of the upper once every N indexing cycles.

2. The improvement according to claim 1, wherein said software program of said video camera apparatus produces an output signal for braking the upper film in order to stretch said portion of the upper film at said sealing station an approximate length L, where L is equal to Nd, where N is said numeral greater than one, and d is said difference between the length of an indexing cycle and the length of a said repeating pattern of printed matter on said portion of the upper face of the upper film.

3. The improvement according to claim 2, wherein N is a numerical value between two and twenty five.

4. The improvement according to claim 2, wherein said second section of said software program of said video camera apparatus that produces said output signal during the downward movement of said lower tool at said sealing station when the upper film is stationary and before the end of the current indexing cycle has occurred, which end of the current indexing cycle is defined as the tool's-down position of said lower tool at said sealing station; said portion of said software program actuating the braking mechanism to brake the upper film during the next indexing cycle after said current indexing cycle.

5. The improvement according to claim 2, wherein said sealing station further comprises a supply of said upper film, said portion of said upper portion of said upper film at said sealing station extending between said supply of said upper film and the rearward sealed end of a transverse section of the upper film sealed to the corresponding end lower film during the current indexing cycle; said portion of said upper film having a plurality of said repeating patterns of printed matter in said longitudinal indexing direction being equal to or greater than the length of N indexing cycles.

6. An indexing packaging machine comprising:

a main frame;

a sealing station at which an upper film having a repeating pattern of printed matter on the upper face thereof is sealingly attached to a lower film, which sealing station comprises a vertically-movable lower tool and an upper tool, a sensor for sensing misalignment of the upper film relative to the lower film, and a braking mechanism for braking the upper film in order to cause the stretching of a portion of the upper film at said sealing station;

said sensor comprising a video camera apparatus focused on said portion of the upper film at said sealing station for detecting a predetermined target on a said repeating pattern of printed matter on the upper face of the upper film, and an actuator for actuating said braking mechanism when a predetermined target of a said repeating pattern of printed matter has been detected by said video camera apparatus;

said video camera apparatus comprising a memory and at least one software program stored in said memory, said at least one software program comprising a first section for storing an image of the predetermined target on the upper face of the upper film and a second section for producing an output signal for said actuator for braking the upper film a predetermined distance from the end of indexing when a predetermined target on a said repeating pattern of printed matter has been detected;

said second section producing said output signal for said actuator of said braking mechanism for stretching said portion of the upper film an amount greater than the difference between the length of an indexing cycle and the shorter length of a said repeating pattern of printed matter on said portion of the upper face of the upper film that constitutes the upper sealing layer of a package being sealed at said sealing station, which length is taken in the longitudinal indexing direction;

said at least one software program comprising a detecting portion for detecting a predetermined target on the upper face of the upper film at a frequency F equal to N indexing cycles, where F is a numeral greater than one representing the frequency of detection of a predetermined target by said video camera apparatus, and N is a numerical value greater than one, whereby said video camera apparatus detects a predetermined target on a said repeating pattern of printed matter of said portion of the upper face of the upper once every N indexing cycles.

7. The indexing packaging machine according to claim 6, wherein said at least one software program of said video camera apparatus produces an output signal for braking the upper film in order to stretch said portion of the upper film at said sealing station an approximate length L, where L is equal to Nd, where N is said numeral greater than one, and d is said difference between the length of an indexing cycle and the length of a said repeating pattern of printed matter on said portion of the upper face of the upper film.

8. The indexing packaging machine according to claim 6, wherein N is a numerical value between two and twenty five.

9. The improvement according to claim 6, wherein said second section of said at least one software program of said video camera apparatus produces said output signal during the downward movement of said lower tool at said sealing station and before the end of the current indexing cycle has occurred, which end of the current indexing cycle is defined as the tool's-down position of said lower tool at said sealing station; said portion of said software program actuating the braking mechanism to brake the upper film during the next indexing cycle after said current indexing cycle.

10. The indexing packaging machine according to claim 6, wherein said sealing station further comprises a supply of said upper film, said portion of said upper portion of said upper film at said sealing station extending between said supply of said upper film and the rearward sealed end of a transverse section of the upper film sealed to the corresponding end lower film during the current indexing cycle; said portion of said upper film having a plurality of said repeating patterns of printed matter in said longitudinal indexing direction being equal to or greater than the length of N indexing cycles.

* * * * *